US006030323A

United States Patent [19]

Fontenot et al.

[11] Patent Number: 6,030,323

[45] Date of Patent: Feb. 29, 2000

[54] EXERCISE APPARATUS

[76] Inventors: Anthony Fontenot, 1518 Jamie St., Mamou, La. 70554; Robert N. Montgomery, 109 Brownlee Ave., Broussard, La. 70518

[21] Appl. No.: 09/047,921

[22] Filed: Mar. 25, 1998

[51] Int. Cl.[7] ..... A63B 21/00

[52] U.S. Cl. ..... 482/111; 482/129

[58] Field of Search ..... 482/91, 92, 111–115, 482/120, 121–125, 129, 130, 134–138

[56] References Cited

U.S. PATENT DOCUMENTS 4,494,662 1/1985 Clymer .
4,620,704 11/1986 Shifferaw ..... 482/130
4,660,828 4/1987 Weiss ..... 482/123
5,234,392 8/1993 Clark ..... 482/54
5,322,492 6/1994 Pearson ..... 482/129

*Primary Examiner*—Glenn E. Richman
*Attorney, Agent, or Firm*—Robert N. Montgomery

[57] ABSTRACT

A method of abdominal exercise utilizing an apparatus which includes a flexible element mounted to a seat, the flexible element having a transverse handle manipulated by a user in at least two planes when sitting on the seat straddling the flexible element. The apparatus further includes a back strap and a lap belt. The flexible element in one embodiment being a urethane column having rigidity control by vertical adjustment of the handle relative to the column. The flexible element in a second embodiment is a self-contained fluidized unit providing resistance in at least two planes.

19 Claims, 9 Drawing Sheets

EXERCISE APPARATUS

BACKGROUND OF THE INVENTION

1. Field of the Invention

This invention utilizes the basic concept for an exercise apparatus disclosed in my earlier filed pending U.S. patent application Ser. No. 08/999,656, which is hereby incorporated by reference.

This invention relates to exercise machines and more particularly to a an isometric exercise apparatus wherein the apparatus imparts a resistive force in multiple planes without the use of, springs, weights, pulleys, or compound levers, ropes and the like.

2. General Background

Exercise apparatus developed for home use often emulate that of equipment used in fitness centers and the like. However, in most homes space is at a premium and simply does not provide one with adequate space indoors for exercise. Further, office workers who perform repetitious work for long periods each day also need to work their muscles to relieve stress and tension. Individuals who know that they need to exercise more but simply do not have the time or those who have special medical problems which require specific therapy often need an exercise aid which is both convenient and efficient. In many cases exercise equipment is too bulky or heavy, even when foldable, for it to be utilized in limited space. Exercise equipment which must be set up or mounted is a significant problem for individuals with limited space. Therefore, isometric exercise performed with the use of aids such as hand grips, dumb bells, elastic devices and springs have been developed. Most such devices tend to focus on hands and certain arm muscles. However, one such device has been developed to aid in exercising the upper torso of the body as disclosed by U.S. Pat. No. 4,494,662 to Clymer. Such devices tend to rely on springs and the like to provide a resistance. It has been observed that the springs and elastic members have a fast response time for returning the spring or elastic band element to a non-deformed state. This is sometimes referred to as snap back or recoil. Therefore, springs and elastic members tend to store energy which increases proportionally as force is applied rather than simply deforming at a constant rate and returning to a normal or non-deformed state at a constant rate such as would be the case with a gas cylinder. The sudden release of stored energy is often a problem for the physically impaired individual. The Clymer apparatus, which requires mounting to a surface, is also a problem in that there is a need for such devices to be both compact, portable and operable on virtually any chair or surface.

SUMMARY OF THE INVENTION

As disclosed in my earlier filed application identified above, the direct manipulation by distortion of a polymeric member has been found to be beneficial in exercise routines by both the physically able and the physically challenged.

Exercise regimens are designed to meet the specific need of the individual's circumstance. Therapeutic exercises are prescribed to fit the needs of individuals according to their abilities. Therefore, weights which snap back in free fall or elastic bands which have progressive resistance and snap back when released tend to be ineffective, especially for use with the physically challenged or those with particular problems such as burn victims or paraplegics. Exercise of the neck, shoulders, back and abdominal muscles is particularly sensitive for the physically challenged and the able bodied alike. The present invention solves the problem by providing an apparatus which relies on a single polymeric member as the principle resistance member. The direct manipulation through distortion of this member, allowing both torque and bending to occur simultaneously, provides the user with freedom of movement in all planes. The physically challenged individual can thus move in the planes which do not produce pain and to the limits desired.

In the preferred embodiment a seat portion having a polymeric member attached thereto is manipulated by a tubular handle assembly in the form of rectangle, but can be shaped in almost any configuration, freely supported by the polymeric member. The seat and its polymeric member has no support legs and is not mounted to any surface. The nature of the polymeric material and its construction offers the user a predetermined resistive force in all planes, including applied torque. The polymeric member, while offering resistance, releases very little energy, thus drastically reducing rebound or recoil. With this innovative apparatus, the user manipulates the handle bar and its dynamic resistive force polymeric member while in a seated position. Individuals with special health problems, such as paraplegics, may use the exercise apparatus by utilizing the special straps which allow the individual to be securely strapped to the seat portion of the apparatus, thus becoming an intricate part of the apparatus.

The direct manipulation of such a polymeric member by users having such freedom is highly preferred over the other exercise equipment which depends on free weights and cables, hydraulic cylinders and elastic bands which generally operate in only one plane.

The present invention is both compact and portable and is padded on both sides of the seat thus allowing the user to position the apparatus in virtually any chair, including a wheel chair or on any flat surface. The user then performs an exercise regimen which may comprise the following:

Horizontal twisting from side to side;
Vertical to Forward crunch;
Forward crunch with twisting motion;
Vertical side to side oblique bends or crunch;
Leaning back twist; and
Lower back extension.

BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

DETAILED DESCRIPTION OF THE PREFERRED EMBODIMENT

Figure 1:
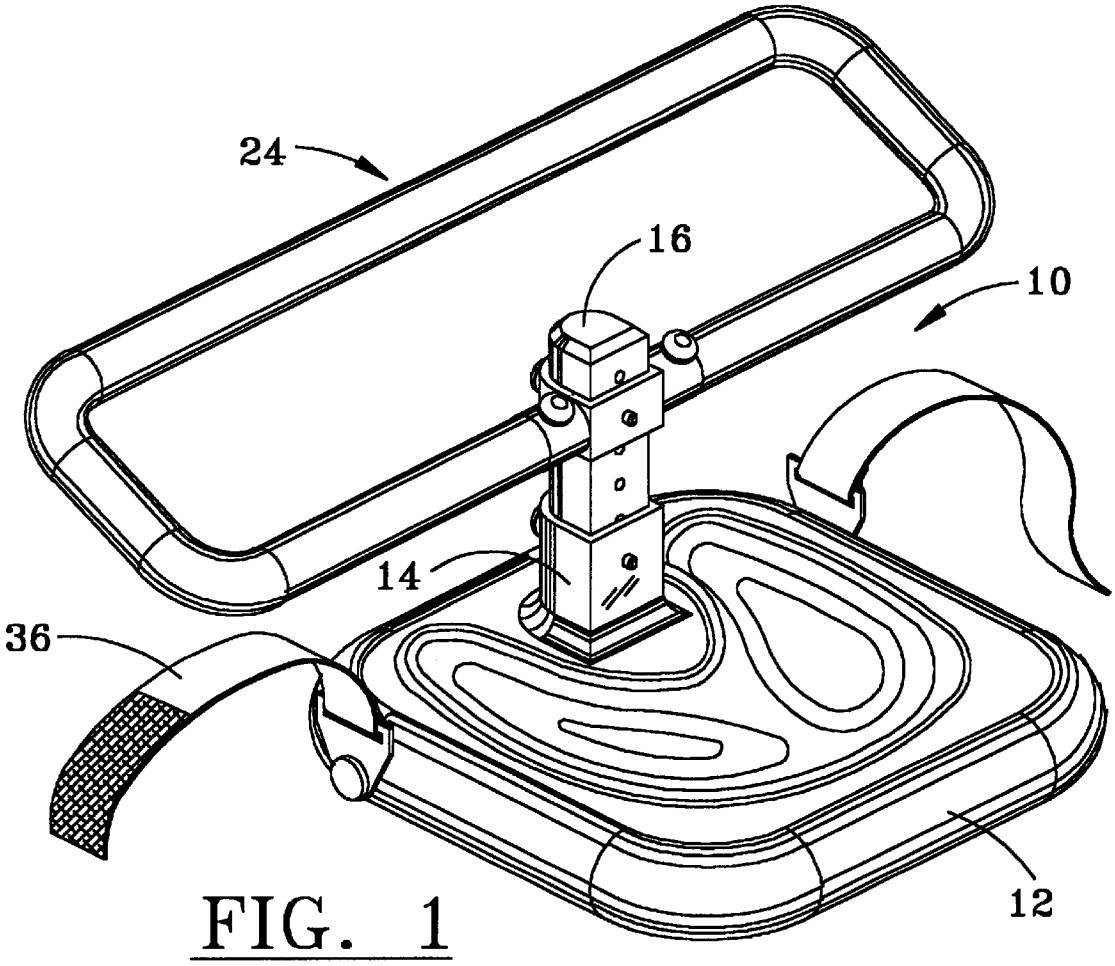
FIG. 1 is an isometric view of the preferred embodiment.
Figure 2:
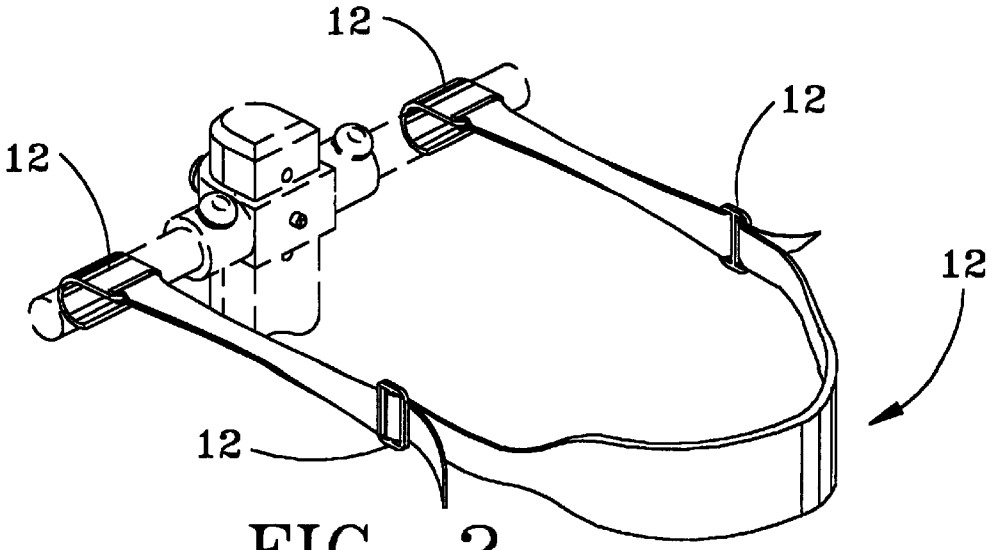
FIG. 2 is an isometric view of the back strap.
Figure 3:
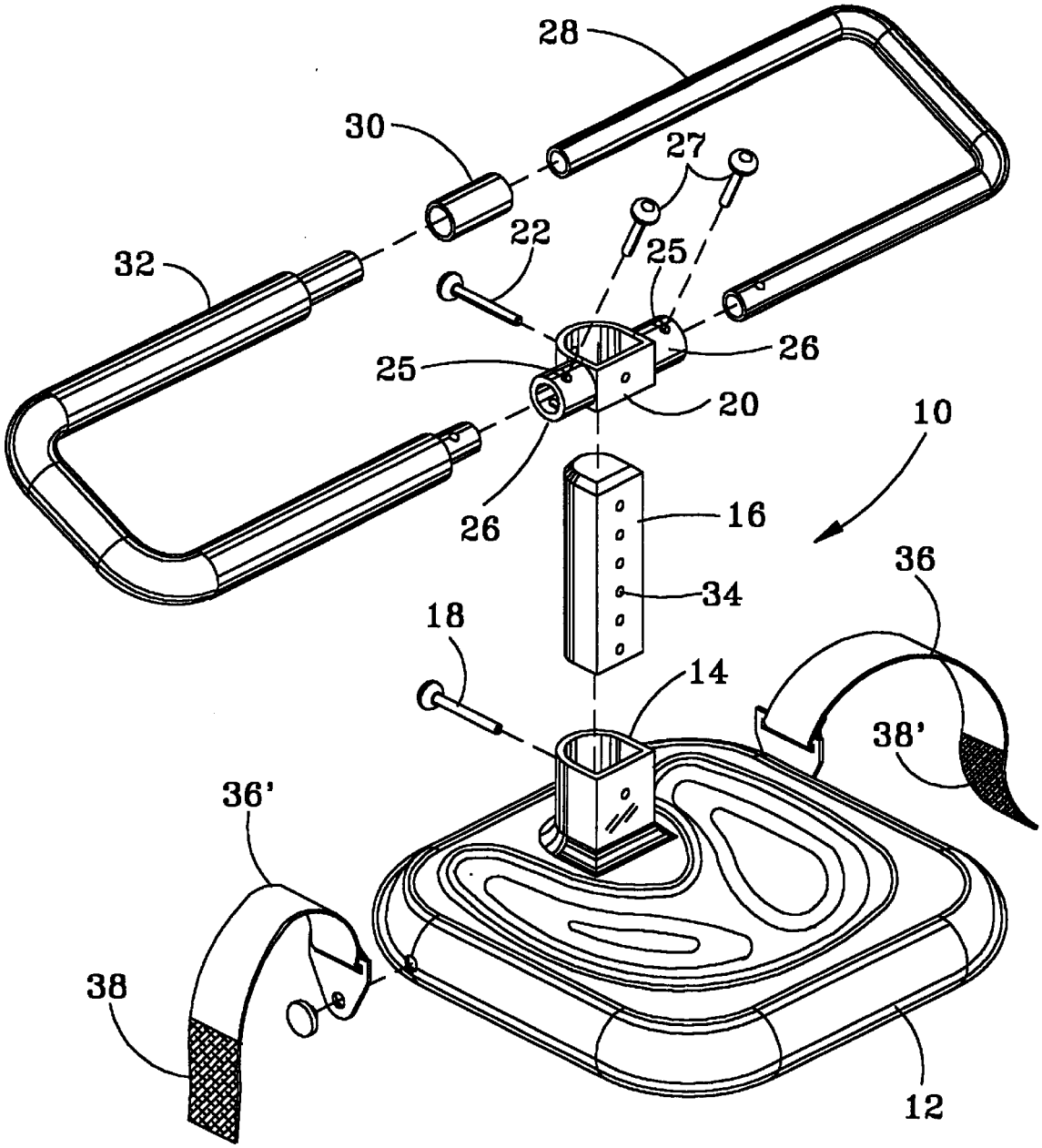
FIG. 3 is an exploded view of the preferred embodiment.

As illustrated in FIG. 1 the exercise apparatus 10 is comprised of a contoured seat portion 12 having a socket portion 14 for retaining a flexible or semi-flexible urethane column member 16, the flexible urethane member 16 being secured to the socket 14 by a pull pin 18 best seen in FIG. 3 passing through the socket 14 and urethane member 16. A collar 20 is then fitted to the upper portion of the urethane column 16 and also pined with a pull pin 22. Tubing forming a rectangular handle assembly 24 is fitted into handle sockets 26 attached to the collar 20 as seen in FIG. 3 in a manner whereby the handle assembly 24 may be fixed at an angle of approximately 15 degrees off the horizontal forwardly from the seat and urethane column 16. The handle assembly 24 may be allowed to rotate to the vertical position within fixed limits by adjustment of the handle retainer pins 27 located in slots 25 in the collar tubular sockets 26. The tubular handle may be made by forming two U-shaped elements 28 and joining them with a coupling 30 thereby forming a rectangle. The rectangular handle assembly 24 has one side intersecting and telescopically engaging the collar tubular sockets 26. The tubular handle should be covered with a foam padding 32 to insure comfort and a positive grip. The urethane member 16 is provided with a number of holes 34 which allow the collar to be positioned at multiple stages closer to the socket 14, thus lowering the center of gravity and reducing the flexibility of the urethane member. The seat 12 is heavily padded on all sides and contoured to fit the human buttocks. A pair of belts 35,36' is provided having hook and loop fastenings 38, 38' and attached to the edges of the seat for securing the legs of the user to the seat. The exercise apparatus 10 may be used by positioning the seat on any flat surface such as a chair, ledge or desktop, in a manner whereby the user is positioned as illustrated in FIGS. 4–7. A back belt 40 as seen in FIG. 2 is also provided with length adjustments 42 and hooks 42 for connecting the belt to a portion of the handle assembly 24.

For purposes of structure, the flexible member 16 could be any resilient, semi-flexible material such as urethane. In any case, the flexible member 16 of the preferred embodiment should be sufficiently flexible in all planes, including the oblique, when manipulated by the handle assembly 24 or the back belt 40, yet be rigid enough to provide resistance to bending and torque in the positions illustrated in FIGS. 4–7. In addition, the shape of the handle assembly 24 is important in that it must have the ability to allow the proper placement and positioning of the hands and allow for full muscle extension in multiple planes. The transverse handle 24 must also be of a length which allows the user to manipulate the semi-flexible polymeric column 16 in all planes, yet still provide the required resistance. Further, the durometer hardness and shape of the polymeric flexible column 16 may vary depending on the resistance required for specific regimens. However, the most efficient geometric configuration and durometer seems to be the partial elliptical shape illustrated in FIG. 3 having a durometer hardness of between 65A and 95A. Adjustment of the collar 20 by locating it closer to the socket 14 reduces the length of the semi-flexible column 16, thereby increasing the rigidity of the semi-flexible column 16 and thus increasing resistance. Simply exchanging the flexible column with one having a higher or lower durometer or a slightly different shape will change the resistance required to bend or torque the column in various planes. Therefore, several flexible columns may be provided with the apparatus. In either case the apparatus is considered to have variable resistance.

A clear distinction must be drawn between the use of a polymeric resistance member such as urethane and a spring member. A helical coil spring is prestressed into a fixed diameter with the coils spaced to provide either extension or compression. The coil diameter, coil spacing and the size, type and heat treatment of the wire determine the amount of deflection allowable before a permanent set is imparted into the spring. The amount of deflection is generally very low. Although helical coil springs may be defected along their linear central axis and in two planes, such bending does not produce uniform resistance in both planes. Especially so when the coils do not have uniform diameters. Further, helical coil springs may also be torqued to some extent. However, this movement is not recommended due to the small section modulus of the wire and the small elastic limit of the wire material relative to the spring's compression or extension ratio. Again, torque resistance is not uniform in both directions due to the prestreess in the spring coils and is compounded when combined with bending in multiple planes.

The elastic limits and ductility of polyurethane is twice that of rubber and drastically exceeds that of metal. Where a column of such material is used, in place of a spring, distortion may be achieved with less stress on the material and with a more uniform resistance in multiple planes. Polymerics tend to absorb or dampen energy rather than storing energy like a spring, thus reducing rebound. Therefore, the time required to restore a polymeric member to an undistorted shape is significantly greater than that of a spring. Some flexible polymeric materials have memory which allows the material to return to its original shape after being distorted over a long period of time. In any case, it is obvious that polymeric materials are more fluidic than springs, thus reducing rebound and providing a more uniform resistance.

Figure 8:
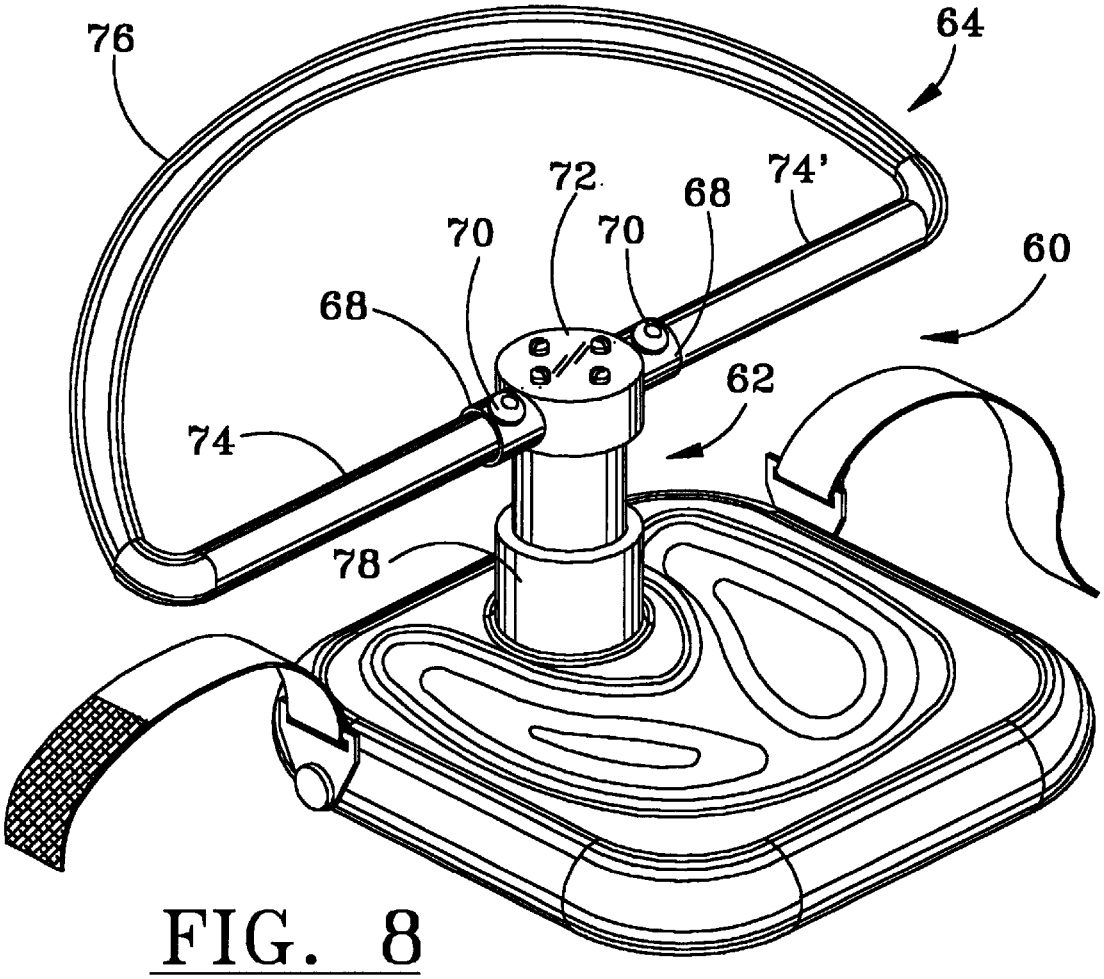
FIG. 8 is an isometric view of a second embodiment of the exercise apparatus.
Figure 9:
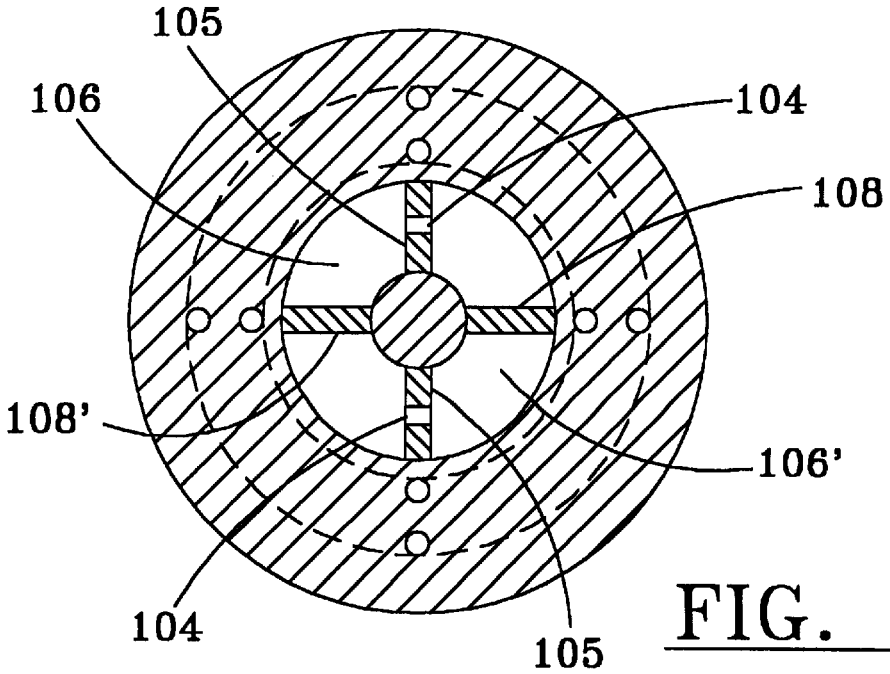
FIG. 9 is a cross section view of the hydraulic unit illustrated in FIG. 10 taken along sight line 9—9.
Figure 10:
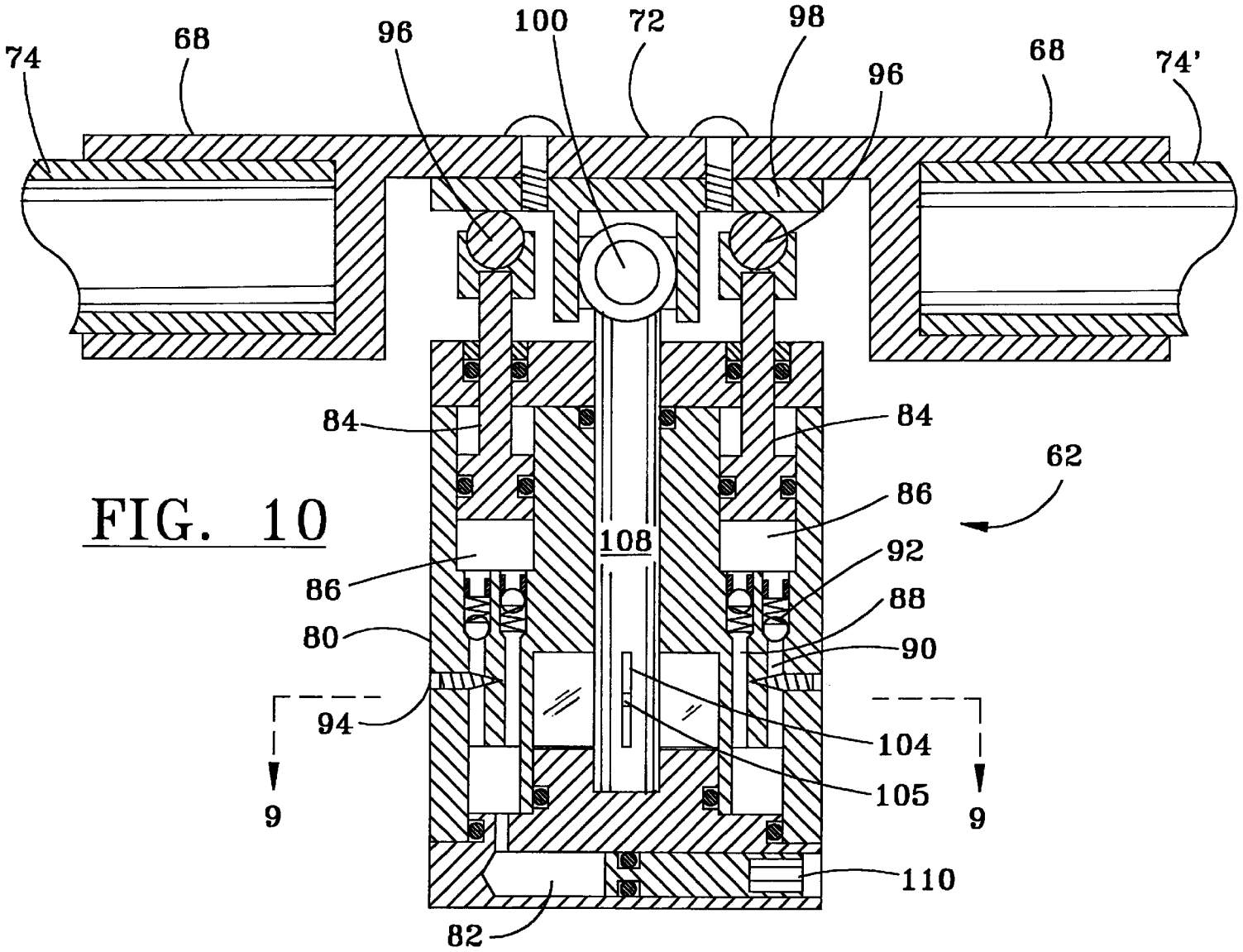
FIG. 10 is a partial cross section view of the hydraulic unit shown in FIG. 8.
Figure 11:
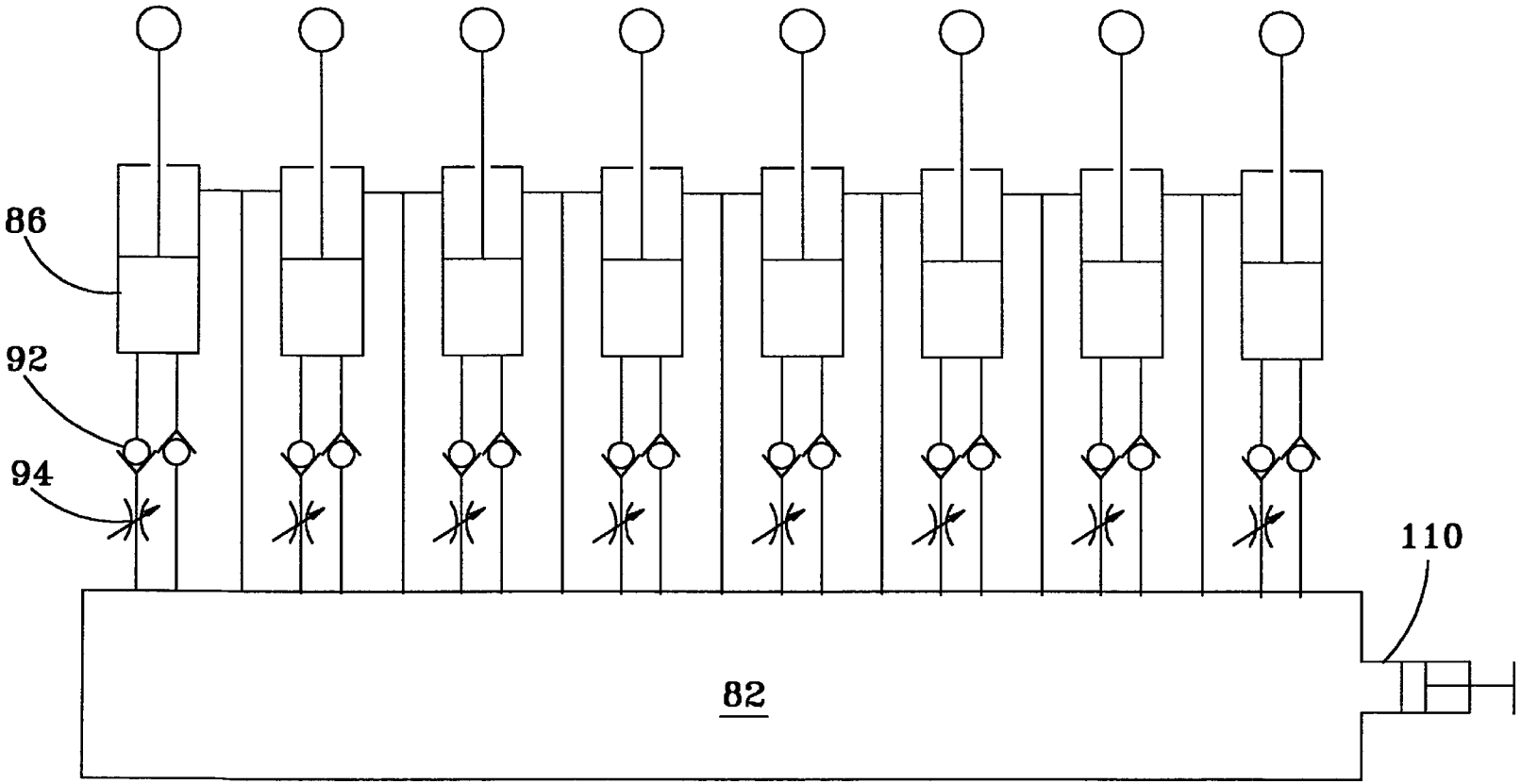
FIG. 11 is a hydraulic schmatic for the hydraulic unit illustrated in FIG. 9.

A true fluidized system may also be provide as seen in FIGS. 8–10. A second embodiment 60 as illustrated by FIG. 8 utilizes a hydraulic fluid unit 62 as its resistive element. Since the resistive effort can be controlled hydraulically, a smaller handle assemble 64 having a "D" shape can be utilized to manipulate the hydraulic element 62. The handle assembly 64 still utilizes sockets 68 and retainer pins 70 similar in function to that used in the first embodiment. However, a cap 72 is used in place of the collar. The handle assembly includes straight portions 74 and 74' and a curved portion 76. This embodiment uses the same seat assembly as that of the first embodiment except for the socket configuration 78. As seen in the FIG. 10 cross section, the hydraulic element utilizes a cylindrical body 80 having a sealed hydraulic chamber 82 and a plurality of tiny cylinders 84 operative inside cylindrical chambers 86. Each cylinder chamber 86 is connected to the sealed reservoir 82 by intake 88 and return ports 90, each having directional flow checks 92. At least one of the cylinder ports is fitted with a flow control 94 to control the velocity of the fluid entering or leaving the chamber 86. The rod ends of the cylinders 84 are fitted with a ball 96 which is in contact with the striker plate 98. The striker plate 98 attaches to the underside of the handle assembly 64 cap portion 72. A ball swivel joint 100 connects the striker plate 98 to a rod 102 extending centrally into the interior of the body 80 culminating in fluid filled chambers 106 and 106' seen in FIG. 9. The rod 102 is fitted with a pair of fins 104 having an orifice 105 in each. The chamber is divided into two chambers 106 and 106' by two partitions 108 and 108'. Therefore, rotation of the rod 102 via the handle assembly 64 and ball joint 100 forces the fluid in the chambers 106 and 106' to be compressed between the partitions 108 and 108' and the fins 104 and 104', thus forcing fluid through the orifices 105 in each fin 104 and 104'. This allows for handle torque resistance. As best seen in the schematic of FIG. 11 fluid sealed inside chamber 82 is pressurized by a hand cranked manually operated cylinder 110. This may be accomplished by a threaded ram which simply applies pressure to the fluid in the chamber when tightened. The fluid in the chamber 82 is then forced into each of the chambers 86 via the check valves 92. Fluid is also forced into the rode chamber 84 thereby partially neutralizing the cylinders and preventing suction on the cylinder when manually displaced. However, displacement of the cylinders is limited by the cylinder stroke and the distance between the hydraulic unit body 80 and the striker plate 98. When the striker plate 98 is displaced in any direction, including the oblique, one or more of the cylinders 84 is actuated thus forcing fluid out the outlet port 90 via the check 92 and flow control 94 back into reservoir 82. The fluid displaced from each cylinder chamber 86 is forced into the undisplaced cylinders via the inlet check 92. The flow controls 94 may be placed in one or both of the intake and outlet ports 88, 90 and they may be controlled as well if desired. Equalizing fluid being forced in and from the cylinder chambers 84 also serves to dampen movement of handle assembly 64.

Operation of the exercise apparatus utilizing either of the embodiments may be seen in FIGS. 4–7 wherein a user 50 places the apparatus 10 or 64 in a chair 52 and sits straddling the flexible polymeric column 16 or the hydraulic element 62. Various regimens may then be carried out by the user to exercise and strengthen the abdominal muscles by manipulating the handle assembly 24, 64. Such exercise regimens include but are not limited to the following.

Figure 7:
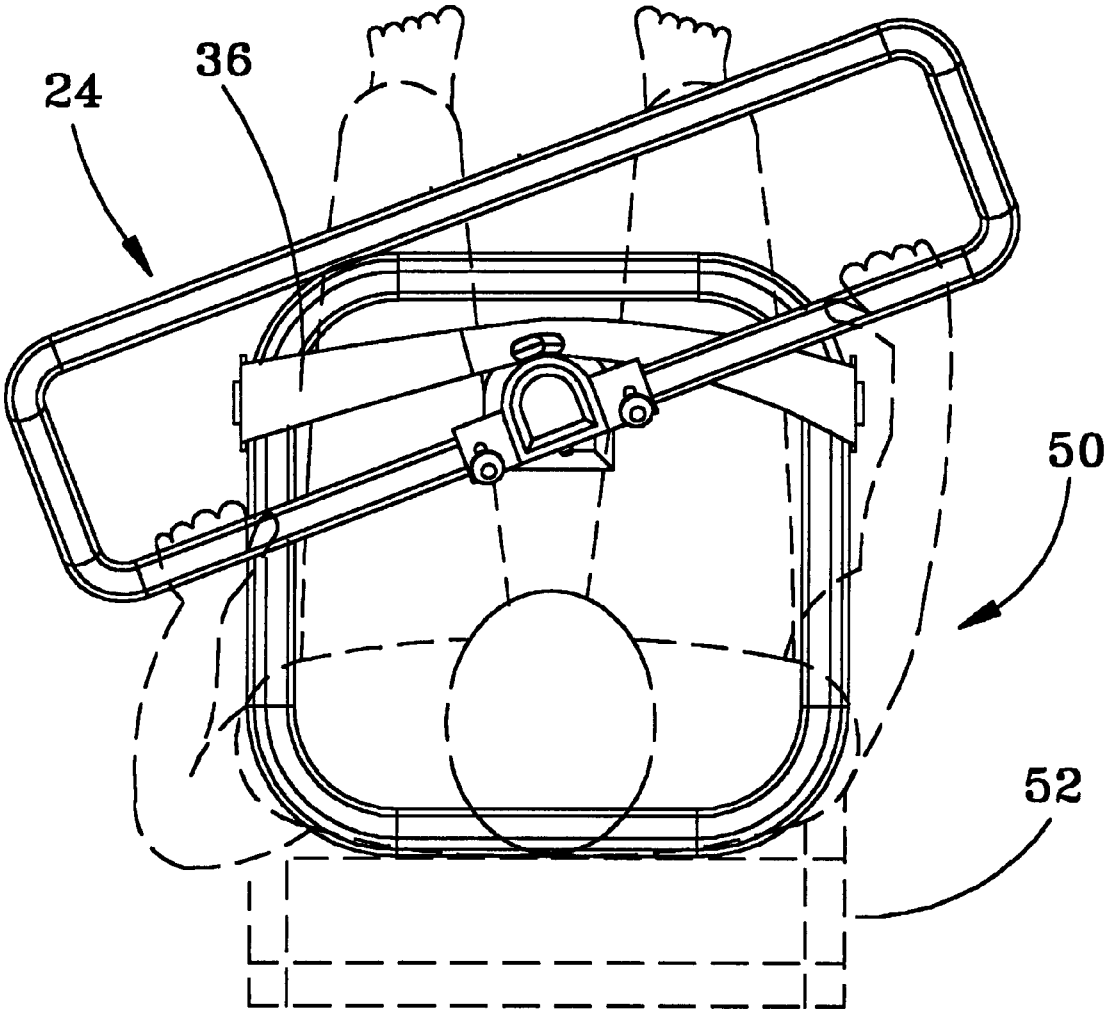
FIG. 7 is a top view illustrating the side to side twisting movement.

Horizontal Twist: as seen in FIG. 7 this routine involves a side to side movement of simply twisting the upper torso relative to the lower extremities, resisted by the apparatus's polymeric member. This routine raises the metabolic rate thereby excellerating the expenditures of calories in the entire midsection. The apparatus places special emphasis on waist line and lower back muscle development by affecting external oblique, rectos abdominis muscles, latimus dorsi, pectoris major muscles and intercostal muscles.

Figure 4:
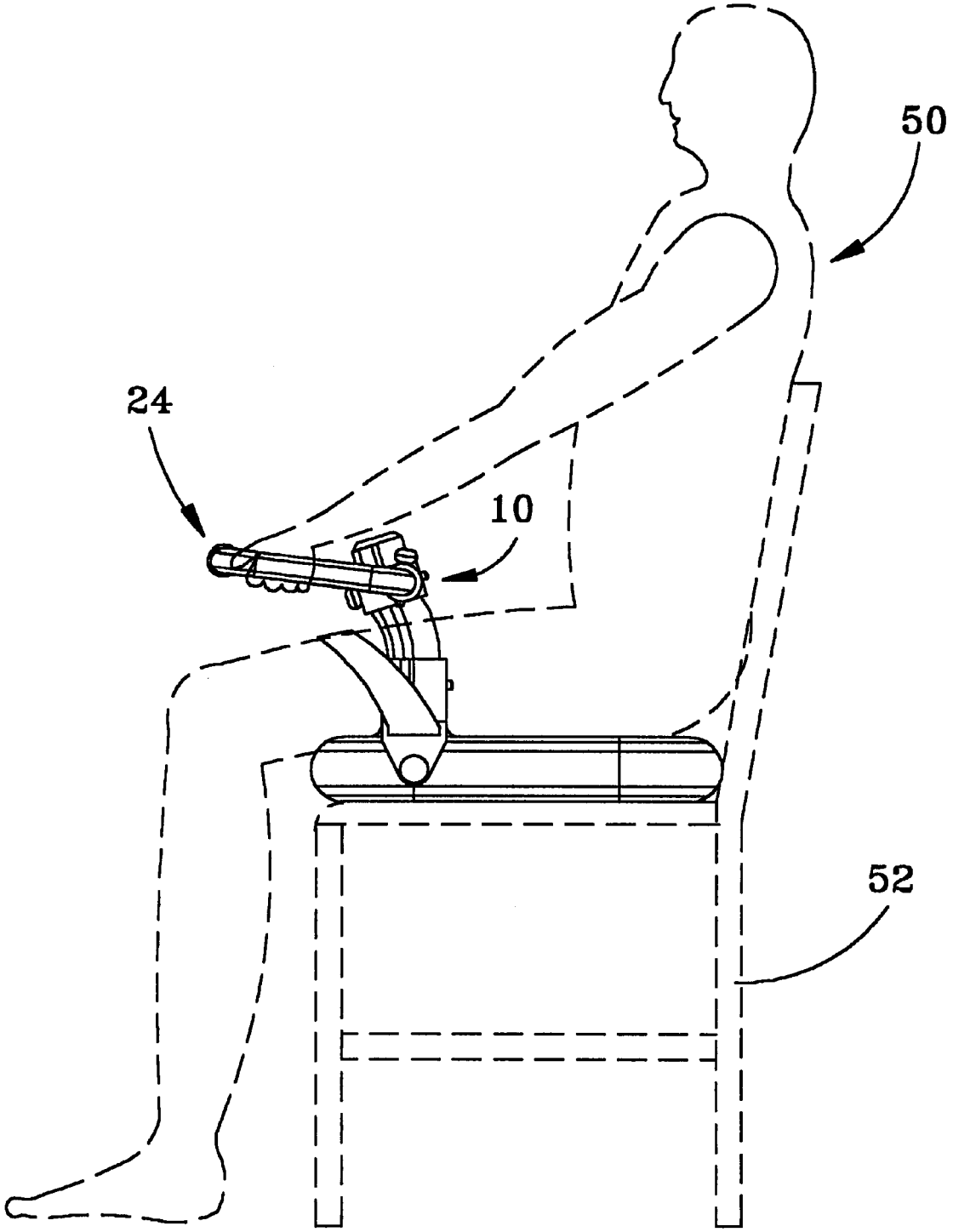
FIG. 4 is a vertical side elevation view illustrating a forward movement of the apparatus.
Figure 5:
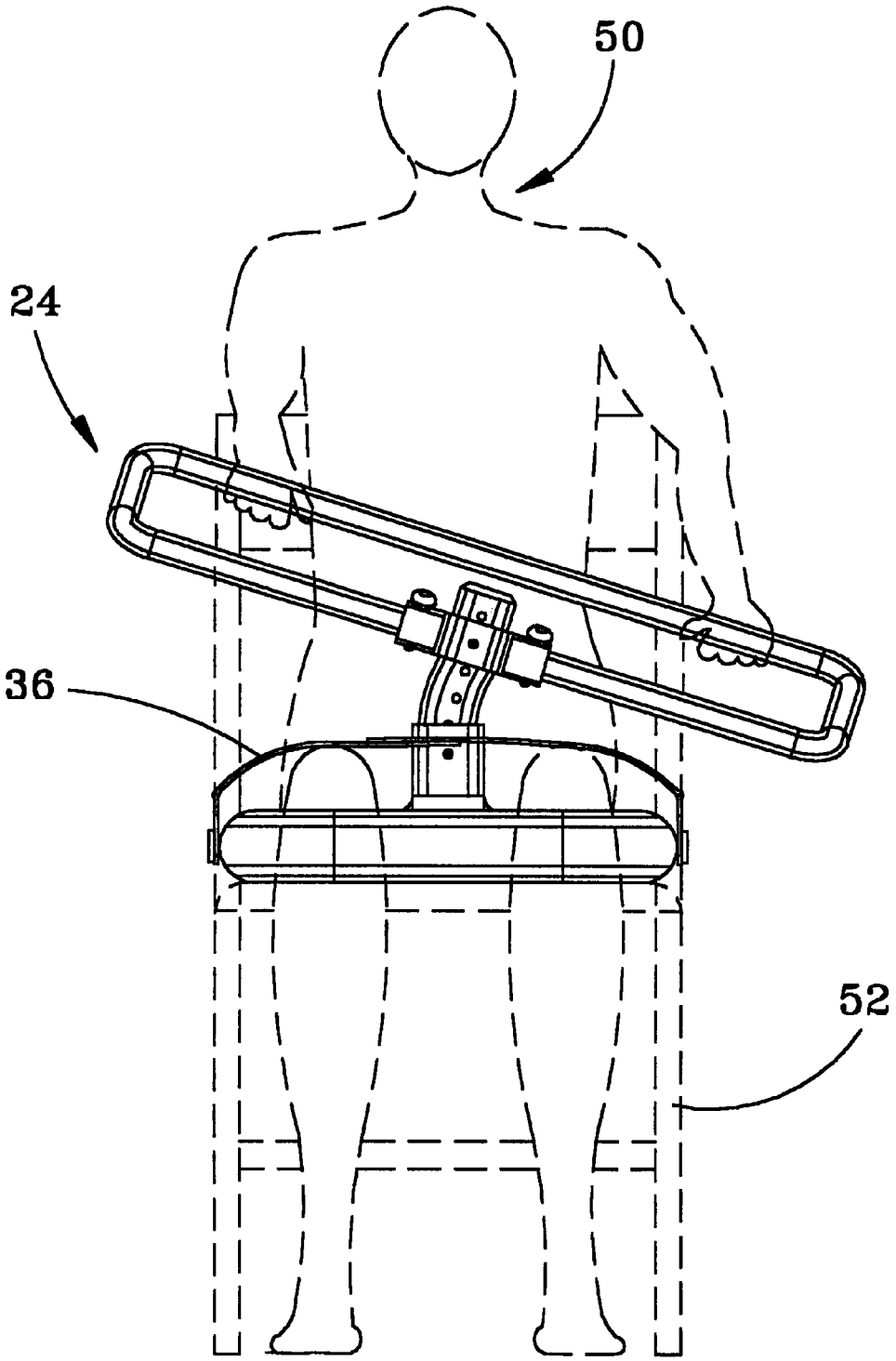
FIG. 5 is a vertical front elevation view illustrating a side to side movement of the apparatus.

Forward Crunch: as seen in FIG. 4 pushing forward on the polymeric member in a forward pivotal manner affects all abdominal muscles. Forward bending Twist: as seen in FIG. 5 is a forward crunch to the oblique, thereby isolating all interconnected abdominal muscles. This exercise utilizes the unique rectangular handle bars to maintain one hand on the upper bar with the other hand on the lower bar, thereby insuring proper muscle activation of upper shoulder.

Vertical side to side oblique bends or crunch: performed as a combination of FIGS. 4 and 5. This exercise insures inward curving of the oblique muscles thus reducing fatty deposits around the waist.

Figure 6:
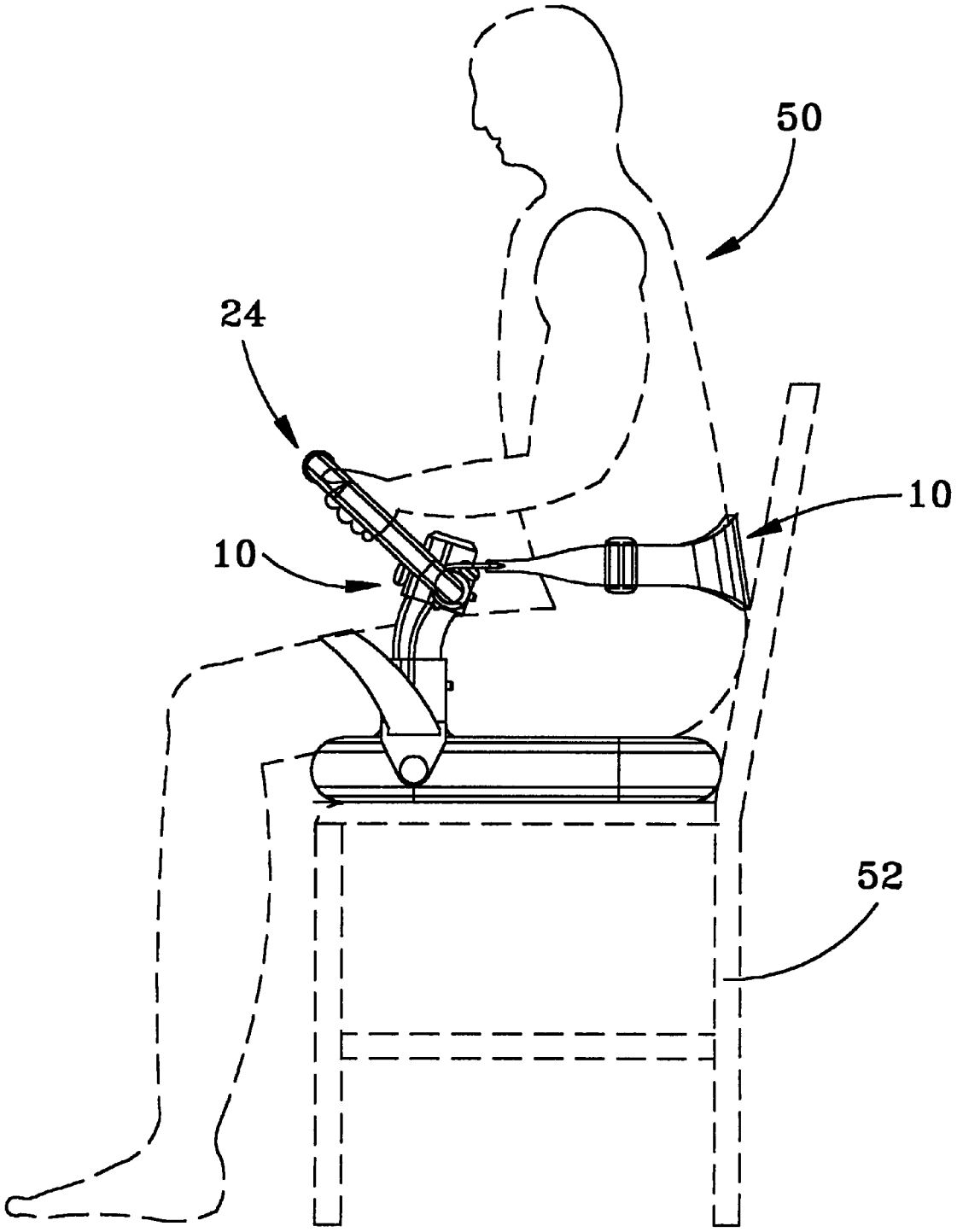
FIG. 6 is a vertical side elevation view illustrating a rearward movement of the apparatus via a back belt.

Backward twist: Performed as the reverse positions utilizing a combination of movement shown in FIGS. 4 and 7. This twisting exercise melts away fat surrounding the lower back and interconnecting mid-section and isolates the upper front abdominal muscles. This routine accelerates the expenditure of calories in the lower back, rear sides and waistline in general. Lower back extension: As seen in FIG. 6, this exercise utilizes a back strap 40 which attaches to the rectangular bar handles 24 and extends around the user's back. The user then extends the back without using hands on the handle bar or may increase the resistance by extending the handle bar forwardly as shown in FIG. 4 while extending the back. The back strap 40 is adjustable so that it can be adjusted to meet the size and extension capability of the user.

The leg strap 36 seen in FIGS. 4–7 may be used in any exercise regimen to assist the user in maintaining proper balance with the apparatus.

These exercises utilize and strengthen the transverse abdominal muscles, the entire lower lumber region and all of the midsection interconnected abdominals. The exercise further strengths the lower back to assist frontal compensatory weight distribution discomfort problems associated with child birth.

Because many varying and different embodiments may be made within the scope of the inventive concept herein taught, and because many modification may be made in the embodiments herein detailed in accordance with the descriptive requirement of the law, it is to be understood that the details herein are to be interpreted as illustrative and not in any limiting sense.

What is claimed is:

1. An exercise apparatus comprising:

a) a seat having a flexing element attached perpendicular to said seat, said flexing element providing resistive reactance to torque and bending;

b) a handle assembly attached transversely to a portion of said flexing element opposite said seat; and c) a means for adjusting the amount of said resistive reactance provided by said flexing element.

2. An exercise apparatus according to claim 1 wherein said flexing element is a unitized fluid displacement unit having a plurality of cylinders.

3. An exercise apparatus according to claim 2 wherein said means for adjusting the amount of resistance is a hand cranked pressure cylinder acting on a sealed fluid body.

4. A method of exercising the abdominal muscles of a human comprising the steps of:

a) providing an apparatus having a seat attached to a flexing element, said flexing element having a transverse handle means for manipulating said flexing element in at least two planes;

b) placing said apparatus on a horizontal support surface;

c) sitting on said seat straddle of said flexing element;

d) manipulating said flexing element by grasping said handle means and displacing said handle means in a plurality of planes; and e) adjusting resistance of said flexing element as required to effect manipulation of said abdominal muscles.

5. An exercise apparatus comprising:

a) a seat having a means for attaching a polymeric member perpendicular to said seat;

b) a flexible polymeric columnar member attached to said seat;

c) a collar attached adjacent an end of said member opposite said seat; and d) a handle assembly attached transversely to said collar.

6. An exercise apparatus according to claim 5 wherein said seat is padded on all sides with at least one side contoured, thus producing a forward and rearward orientation.

7. An exercise apparatus according to claim 5 wherein said means for attaching a polymeric member is a socket attached perpendicular to said seat, said socket including a removable pin passing through a portion of said socket.

8. An exercise apparatus according to claim 5 wherein said flexible polymeric columnar member is a urethane bar having a plurality of transverse holes.

9. An exercise apparatus according to claim 5 wherein said collar is adapted to fit configuration of said polymeric columnar member and further comprises a pair of tubular sockets attached perpendicular thereto, including a transverse pin traversing each said tubular socket.

10. An exercise apparatus according to claim 5 wherein said handle assembly is a tubular frame in the form of a rectangle, a portion of which intersects and removably engages each said tubular socket.

11. An exercise apparatus according to claim 9 wherein said sockets include slot means for allowing said transverse pin to rotate relative to said tubular socket.

12. An exercise apparatus according to claim 6 wherein said handle assembly is positioned when attached to said collar in a manner whereby a portion of said rectangle is forwardly of said seat and between 15 and 45 degrees above the horizontal.

13. An exercise apparatus according to claim 12 wherein said handle assembly is rotatable within fixed limits relative to said tubular sockets.

14. An exercise apparatus according to claim 5 wherein said collar is incrementally adjustable linearly along said flexible column member.

15. An exercise apparatus according to claim 5 wherein said seat further comprises a pair of belts attached thereto having hook and loop fastening.

16. An exercise apparatus according to claim 5 further comprising a back belt attachable to said handle assembly.

17. A method of exercising upper and abdominal muscles comprising the steps of:

a) providing and exercise apparatus comprising:

i) a seat having a means for attaching a polymeric member perpendicular to said seat;

ii) a flexible polymeric columnar member attached to said seat;

iii) a collar attached adjacent an end of said member opposite said seat; and

IV) a handle assembly attached transversely to said collar;

b) placing said exercise apparatus on a chair; and c) having a user seated on said seat, straddling said flexible columnar member and grasping said handle assembly, said user manipulating said handle in various exercise regimens, thus flexing said columnar members in multiple planes.

18. A method of exercising upper and abdominal muscles according to claim 13 further comprising the step of:

a) providing a back belt;

b) connecting said belt to said handle assembly; and c) manipulating said handle assembly by exerting force with a user's back muscles.

19. A method of exercising upper and abdominal muscles according to claim 13, further including the step of locating said collar downwardly towards said seat linearly along said flexible column, thereby increasing resistive effort required to distort said flexible column.

* * * * *